United States Patent [19]

Fujimura et al.

[11] 4,045,217

[45] Aug. 30, 1977

[54] DEVELOPING PROCESS FOR ELECTROPHOTOGRAPHY

[75] Inventors: Itaru Fujimura, Zushi; Katutoshi Endo, Yokohama, both of Japan

[73] Assignee: Ricoh Company, Ltd., Japan

[21] Appl. No.: 643,817

[22] Filed: Dec. 23, 1975

[30] Foreign Application Priority Data

Dec. 24, 1974 Japan ..... 50-3295

[51] Int. Cl.[2] ..... G03G 15/00

[52] U.S. Cl. ..... 96/1 LY; 118/DIG. 23; 118/647; 355/10; 355/14; 427/17

[58] Field of Search ..... 355/14, 17, 10, 3 R; 96/1 LY, 1 R; 427/15, 17; 118/647, 648, DIG. 23

[56] References Cited

U.S. PATENT DOCUMENTS

| | | | |
|---|---|---|---|
| 3,368,894 | 2/1968 | Matkan et al. | 355/17 X |
| 3,575,505 | 4/1971 | Parmigiani | 355/14 X |
| 3,611,982 | 10/1971 | Coriale et al. | 427/15 X |
| 3,650,622 | 3/1972 | Morse | 355/10 |
| 3,679,453 | 7/1972 | Katagiri et al. | 427/17 |
| 3,707,943 | 1/1973 | Matsumoto et al. | 355/10 X |
| 3,782,818 | 1/1974 | Smith | 355/10 |
| 3,815,989 | 6/1974 | Davis et al. | 355/10 |
| 3,877,413 | 4/1975 | Rowell et al. | 355/14 X |
| 3,892,481 | 7/1975 | Schaefer et al. | 355/10 |
| 3,951,653 | 4/1976 | Matsumoto | 96/1 LY |

*Primary Examiner*—Richard L. Moses
*Attorney, Agent, or Firm*—McGlew and Tuttle

[57] ABSTRACT

The developing process is for use in an electrophotographic copying machine of the wet developing type in which a developing electrode arrangement is maintained in intimately opposing relationship with a cyclically moving endless photosensitive surface carrying an electrostatic latent image on a circumferential surface portion thereof. The remaining portion of the endless surface is charged at a certain potential having a polarity opposite to that of the latent image. A potential on the electrode arrangement is maintained below a predetermined value during the time the latent image carrying surface portion is passing thereby, to achieve correct development, whereas it is charged by a bias potential, lower than the potential previously applied, while the remaining surface portion passes thereby during the remaining time for one cycle of the endless surface. Thereby an accumulation of toner on the electrode arrangement is prevented and hence fogging of the developed image caused thereby is also prevented.

8 Claims, 11 Drawing Figures

DEVELOPING PROCESS FOR ELECTROPHOTOGRAPHY

BACKGROUND OF THE INVENTION

The invention relates to a developing process for electrophotography which may be used in an electrophotographic copying machine of the wet developing type involving the use of a developing electrode.

An electrophotographic process is generally known in which a drum- or sheet-shaped photosensitive member is used to form a reproduced pattern of an original thereon, which is transferred to provide a plurality of copies. Of the developing technique in the process which converts an electrostatic latent image on the photosensitive member into a visual image, the present invention is primarily concerned with the disposition of the developing electrode relative to the surface of the photosensitive member and the potential applied thereto.

In order to facilitate the understanding of the background of the present invention, an electrophotographic process will be initially described with reference to FIG. 1 which illustrates a conventional electrostatic copying machine. A photosensitive member 1 is formed on the peripheral surface of a drum and comprises a well-known photoconductive layer. The photoconductive material used in the example shown is of a type which may be charged to either positive or negative polarity, even though the characteristic is not always symmetrical. For each copying operation, the photosensitive member 1 undergoes a rotation through approximately one revolution in the counterclockwise direction, and such copying operation may be repeated to provide a plurality of copies. During one copying cycle, the surface of the photosensitive member 1 is uniformly charged by a primary charger 2, and is then imagewise exposed to an image pattern of an original through an optical system 3, thereby forming an electrostatic latent image thereon. When the surface of the photosensitive member which carries the latent image moves into opposite relationship with a developing electrode 4, which also serves as a developing solution dishplate, it contacts a layer of developing solution flowing thereacross, electrostatically attracting toner particles dispersed in the solution to form a visual image on the photosensitive member. Subsequently, the photosensitive member 1 is engaged by a squeeze roller 5 to remove an excessive amount of developing solution therefrom, and then brought into opposing relationship with a transfer charger 6, which transfers a toner image carried on the surface thereof onto a record sheet. Any amount of developing solution which remains on the surface of the photosensitive member is removed by a cleaning unit 7, and any remaining charge is removed by an a.c. charge eliminating charger 8. This completes one copying cycle of the photosensitive member 1.

In general, the full perimeter of the photosensitive member 1 is not used for the formation of an image thereon, but its surface is divided (FIGS. 2 and 3) into an image forming region (which is designated as R), and a non-image region (designated as N), depending on the size of an original being copied. Such division is usually determined by the operational relationship between the surface of the photosensitive member 1, the primary charger 2 and the optical system 3. The above description of the electrophotographic process relates to the operations applied to the image forming region R, while, for the non-image region N, the primary charger 2 is not activated and the optical system 3 does not perform an exposure operation, but an original or the optical system undergoes a returning movement, even though the transfer charger 6, the cleaning unit 7 and the charge eliminating charger 8 operate in a manner similar to that for the image forming region R. The charger 8 performs a charging of the drum surface to the opposite polarity from that of the primary charger in order to eliminate any residual potential thereon. However, in the present example, the potential to which the charging by the charger 8 is performed is purposely increased to minimize the deposition of the toner onto the non-image region N and the developing electrode 4, whereby a potential of the opposite polarity remains on the region N subsequent to the charge elimination.

The function of the developing electrode 4 is to minimize the edge effect, to maintain a proper optical density in the image formed, and to prevent the deposition of the toner particles on to a background portion of the image, by applying a suitable bias potential to the electrode 4. The purpose of the application of the bias potential is to prevent a background smearing of the photosensitive member 1 by attracting a toner, which may otherwise be deposited on a background portion in the image which forms region R, to the developing electrode 4, through the application of a bias potential thereto which exceeds the residual potential in the background portion of the region R.

As is known, a bias potential may be applied either by a forced biasing technique, in which an external voltage source is provided to feed the developing electrode 4, or a floating bias technique, in which the developing electrode 4 is isolated from the ground so that a charge may be induced thereon by the charge of the latent image on the photosensitive member 1. If the developing electrode 4 is merely left floating when the floating bias technique is employed, the bias potential may rise excessively when copying an original which has a large proportion of black area, thereby unfavorably degrading the contrast of the image. To avoid this difficulty, it has previously been proposed to use a constant voltage diode connected between the developing electrode 4 and the ground and which has a characteristic breakdown voltage slightly exceeding the maximum value of the residual potential in the background portion.

One example of the developing step according to the floating bias technique will be specifically described with reference to FIGS. 2 and 3, assuming that the primary charging achieved a potential of +600 volts. The non-image region N is charged to a potential of −100 volts, the bias potential is established at a constant value of +150 volts, and the residual potential in the background region is +100 volts. Referring to FIG. 2, which illustrates the image forming region R disposed in opposing relationship with the developing electrode 4, the surface of the photosensitive member 1 will be charged such that an image pattern area P maintains the potential of +600 volts while a background area G maintains the residual potential of +100 volts. The potential on the developing electrode 4, which is induced by the charge of the latent image, will be approximately an average of the both potentials, but is maintained below a value of +150 volts by a varistor having a characteristic value of 150 volts.

As indicated by arrows, the toner particles are attracted toward the latent image in the region of the pattern area P and are attracted toward the developing electrode 4 in the region of the background area G, whereby the latent image is converted into a high quality visual image in which the background area is not developed.

When the non-image region N is located opposite to the developing electrode 4, the uniform potential of −100 volts on the surface of the photosensitive member 1 will induce a potential on the developing electrode 4 which is somewhat less than that and on the order of about −70 volts, as shown in FIG. 3. As a result, the toner particles disposed in the developing solution will be attracted toward the developing electrode 4, as indicated by arrows.

During each copying operation, the deposition of the toner onto the developing electrode 4 is repeated to cause an accumulation of the toner thereon, with the consequence that the biasing effect during the developing step is decreased in a gradual manner, giving rise to the appearance of a background smearing in the copied image. When the original has a reduced optical density, the deposition of the toner to be background region is particularly notable. Such degradation in the biasing effect of the developing electrode is not limited to the floating bias technique, but similarly occurs with the forced bias technique. In this instance, even if the electrode is disconnected from the source of forced or external bias during the time it is located opposite to the non-image region N, the potential of the opposite polarity on the photosensitive member causes the toner particles to be driven toward the developing electrode, whereby the toner is accumulated thereon in the manner similar to that with the floating bias technique.

SUMMARY OF THE INVENTION

Therefore, it is an object of the invention to provide a developing process for electrophotography which eliminates the above difficulties by a forced application, to the developing electrode of a bias potential which is less than the potential of the opposite polarity to which a non-image region is charged during the time the non-image region is located opposite to the developing electrode or during the time except when an image forming region is located opposite to the developing electrode, which time is determined by a delayed synchronization with the operation of the optical system, thus eliminating a contamination of the developing electrode to maintain a proper biasing effect.

DETAILED DESCRIPTION OF EMBODIMENTS

Figure 4:
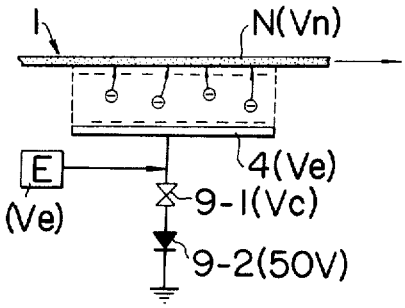
FIG. 4 is a schematic diagram illustrating the principle of the present invention.

Referring to FIG. 4 which illustrates the principle of the invention, there is shown a photosensitive member 1 which has its non-image region N located opposite to a developing electrode 4. When the region N is charged to V*n* volts of the opposite polarity, for example, −100 volts, a voltage of V*e* volts, for example, −200 volts, is applied from a potential source E to the developing electrode 4 in accordance with the invention, and the electrode 4 is connected with the ground through a varistor 9–1 having a threshold value of V*c* volts, for example, 150 volts, and through a constant voltage diode 9–2 having a threshold value of "V*c*-V*e*" volts, which is 50 volts in the present example. The value of the voltage V*e* which is used as the forced bias is generally determined in accordance with the following equation:

$$(|Ve| - |Vn|) \times T_2 = (Vc - Vg) \times T_1$$

wherein *Vn* represents a potential of the opposite polarity from that of the primary charging, which is achieved on the non-image region by uniform charging thereof as a result of eliminating the residual charge thereon subsequent to the transfer step; *Vg* represents a potential remaining in a background area of the latent image; *Vc* represents a bias potential above *Vg* and which is used during the developing step; $T_1$ represents the time duration during which the image forming region R is located opposite to the developing electrode 4; and $T_2$ represents the time duration during which the non-image region is located opposite to the developing electrode.

It will be readily appreciated that the use of such a forced or external bias potential permits the quantity of the toner which is deposited on the developing electrode 4 during the developing step to be substantially balanced with the quantity of the toner which is electrostatically removed therefrom during the remaining time period, so that the surface of the developing electrode 4 is maintained in a clean condition.

Figure 1:
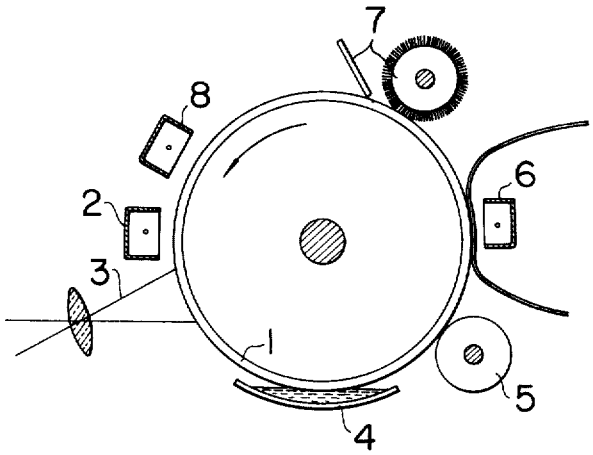
FIG. 1 (PRIOR ART)
FIG. 1 is a schematic view illustrating an electrophotographic copying machine of drum type.
Figure 2:
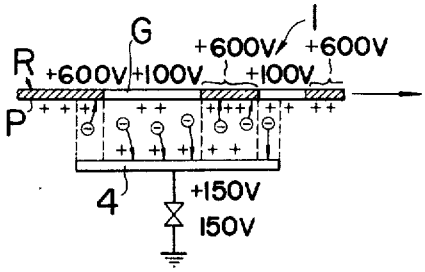
FIG. 2 (PRIOR ART)
FIGS. 2 and 3 are schematic diagrams illustrating the operation of a developing electrode which is operated according the floating bias technique.
Figure 3:
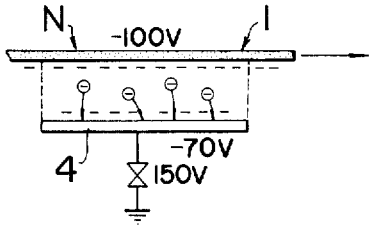
FIG. 3 (PRIOR ART)

More specifically, during time duration $T_1$ during, which the latent image is being developed, the developing electrode 4 functions with a floating bias having a constant potential of 150 volts which is higher than the background potential of +100 volts, thereby attracting the toner away from the background area and toward the developing electrode. On the other hand, during the time duration $T_2$, during which the non-image region N is located opposite to it, the developing electrode is maintained at a forced bias potential of −200 volts which is lower than the potential of the region N which is charged to the opposite polarity of −100 volts, whereby the toner which has deposited on the developing electrode 4 during the developing step is expelled toward the photosensitive member 1, clearing the electrode 4 free from the toner. The toner particles which are deposited on the non-image region N in this manner will be removed to a certain degree by the squeeze roller 5 (see FIG. 1) together with an excess amount of developing solution, and finally eliminated from the photosensitive member 1 by the cleaning unit 7. It should be noted that the non-image region N is charged to the same polarity as that of the toner to facilitate the cleaning action.

In this manner, in accordance with the invention, the developing electrode functions as a floating biased electrode to provide a satisfactory image quality during the developing step, and then is switched to an applied bias Ve to remove the toner therefrom. Such switching takes place repeatedly with a correct timing during the rotation of the photosensitive member 1. If the developing electrode is switched to the applied bias of the opposite polarity while the trailing end of the image forming region R is located opposite thereto, the bias of −200 volts relative to the background potential of +100 volts will cause a fogging in the background area to degrade the copied image. On the contrary, if the developing electrode is switched to a developing bias before the leading end of the image forming region R is located opposite thereto, the deposition of the toner onto the developing electrode rather than the removal of the deposited toner will occur.

Figure 5:
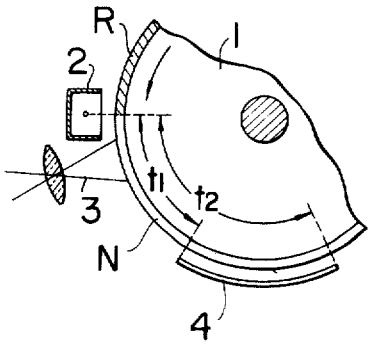
FIG. 5 is a fragmentary view of a photo-sensitive member located in association with a developing electrode for illustrating the timing with which it is located opposite to the latter.

In accordance with the invention, the timing of switching the bias applied to the developing electrode is controlled by a delayed synchronization with the initiation of the operation of the optical system 3 (or the initiation of the primary charging by the charger 2 or the illumination of the optical system 3) and the termination of the exposure (or the termination of the primary charging or the extinction of the optical system 3). Specifically, as illustrated in FIG. 5, the switching from the bias of the opposite polarity to the developing bias takes place $t_1$ seconds after the initiation of operation of the optical system 3, and the switching from the developing bias to the bias of the opposite polarity takes place $t_2$ seconds after the termination of the exposure by the optical system 3. These switchings take place by way of a sequence timer which is usually employed in the copying machine. The time interval $t_1$ represents the time period required for the leading end of the image forming region R to be located opposite to upstream end of the developing electrode 4 after it has been subjected to an exposure, while the time interval $t_2$ represents the time period required for the trailing end of the region R to be removed from the opposing relationship with the developing electrode 4 after the termination of its exposure.

Figure 6:
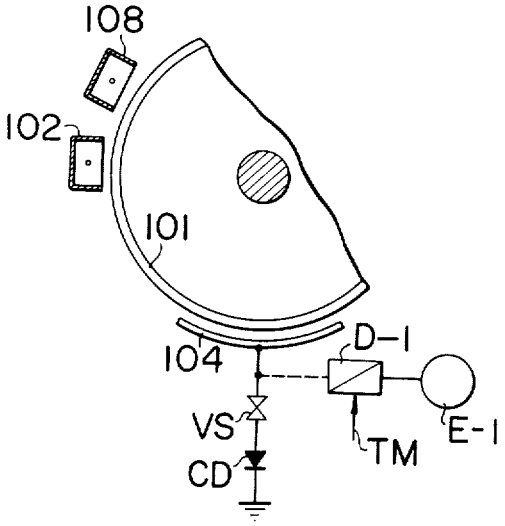
FIG. 6 is a fragmentary schematic view of an electrophotographic copying machine constructed in accordance with one embodiment of the invention.

Referring to FIG. 6, there is shown one embodiment of an electrostatic copying machine of drum type. A photosensitive member 101 is in the form of a drum having a diameter of 120 mm and carrying a 50 micron thick selenium film. Disposed around the drum are a primary charger 102, which is adapted to charge the drum surface to a potential of +5.7 KV, a developing electrode 104 comprising a conventional conductor, a +6 KV transfer corona charger (not shown), and a charge eliminating charger 108 which operates on an a.c. voltage of 6 KV. The developing electrode 104 is connected with the ground through a varistor VS having a threshold value of 150 volts and a constant voltage diode CD having a threshold voltage of 50 volts, both of which are connected in series. The electrode 104 is connected with an external voltage source E-1 of −200 volts through a delayed timing circuit D-1 which determines the time intervals $t_1$, $t_2$. A timing control TM is established such that the circuit connection with the external source E-1 is disconnected at about 0.2 second ($t_1$) after the initiation of operation of the optical system and the external source is connected with the developing electrode at about 0.5 second ($t_2$) after the termination of an exposure when the photosensitive drum 101 is driven with a peripheral speed of 215 mm/sec. During the operation of the copying machine, the developing electrode does not have applied thereto the external potential when the image forming region R passes by it, so that a floating bias prevails, while a negative bias of −200 volts is applied thereto to maintain the biasing effect when it is opposed by the non-image region N.

When a test copying operation is effected with this copying machine, it is found that the developed image exhibited a stable high quality and no deposition of the toner on the developing electrode 104 occurred.

Figure 7:
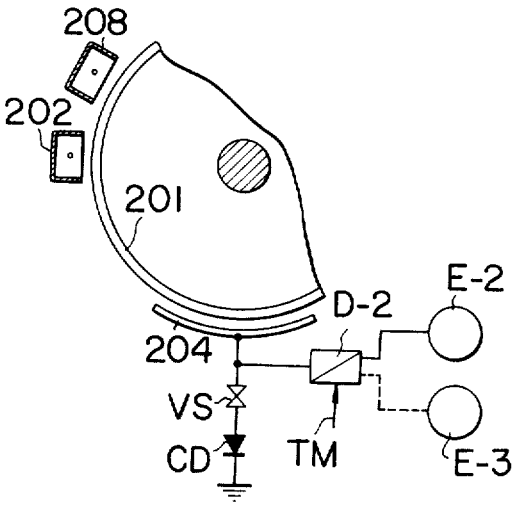
FIGS. 7 to 11 are similar schematic views illustrating other embodiments of the invention.

Referring to FIG. 7, the embodiment shown is generally similar to that shown in FIG. 6. In this Figure and subsequent Figures, parts corresponding to those shown in FIG. 7 are designated by like numerals sequentially incremented by 100. Specifically, the machine includes a photosensitive member 201, a primary charger 202, a developing electrode 204, a transfer charger (not shown) and a charge eliminating charger 208. The electrode 204 is connected with the ground through the varistor and the diode as mentioned above, and is also connected with a delay circuit D-2 which is alternately connected with a first external voltage source E-2 of +150 volts and a second external voltage source E-3 of −200 volts. In this Figure, the solid line indicates the electrical connection during the developing step while the broken lines indicate the connection during the remaining time period.

The copying machine shown has been used to conduct a continuous run over 200 cycles, using an original having a very poor optical density. It is found that the developed image are entirely free from a background smearing with a stabilized image quality, and no deposition of the toner particle onto the developing electrode 204 occurred.

Figure 8:
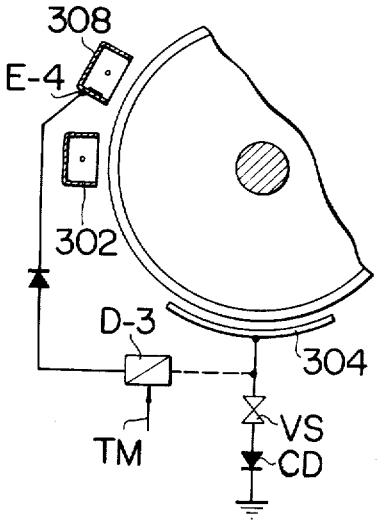

Referring to FIG. 8, a developing electrode 304 is utilized as a floating bias electrode as in the embodiment shown in FIG. 6. Except during the developing step, a negative component of the a.c. voltage, which is produced on a conductive blade internally located within the casing of a charge eliminating charger 308, is derived through a diode to provide a potential E-4 which is utilized as a source of a forced bias of −200 volts.

A continuous run over 200 cycles with this copying machine revealed no occurrence of a background smearing or deposition of the toner onto the developing electrode.

Figure 9:
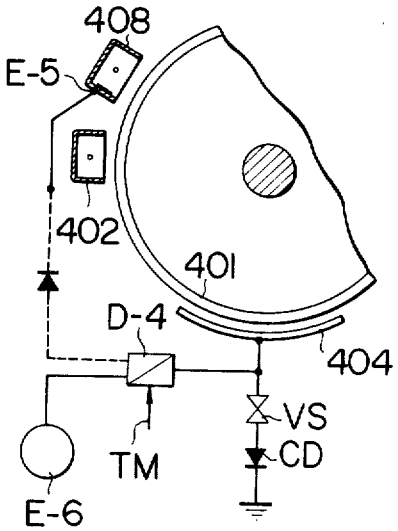

Referring to FIG. 9, the embodiment shown is adapted to utilize an external voltage source E-6 of +150 volts during the developing, as in the embodiment shown in FIG. 7, and to utilize a potential of −200 volts, which is derived from a charge eliminating charger 408, as in the embodiment shown in FIG. 8.

A copying machine constructed in accordance with this embodiment operated with results similar to those mentioned above.

Figure 10:
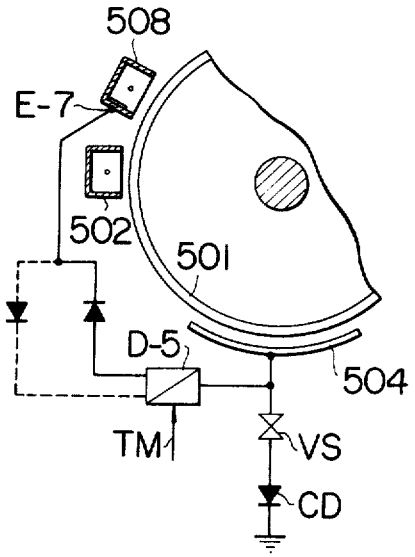

Referring to FIG. 10, the embodiment shown is arranged so that a potential E-7 of −200 volts, which is derived from a charge eliminating charger 508, is utilized during the time other than the developing step, while a potential of +150 volts, which is derived from the charger 508 through an oppositely poled diode, is utilized during the developing.

In a continuous run of a copying machine constructed in accordance with this embodiment over 200 cycles, no deposition of a toner particle onto a developing electrode 504 is found, and a sharp developed image was obtained.

Figure 11:
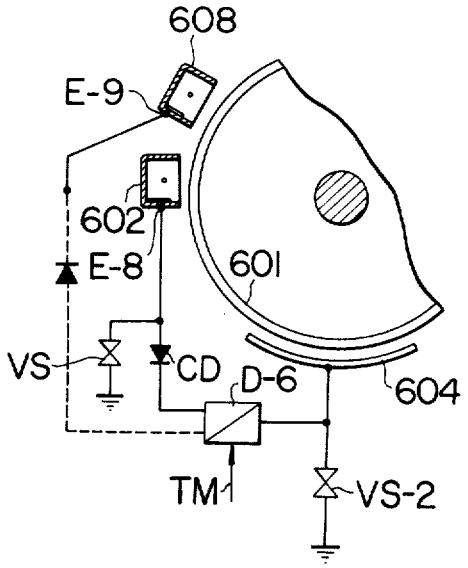

In an embodiment shown in FIG. 11, the developing takes place by utilizing a potential E-8 of +150 volts, which is derived from an electrical conductor located within the casing of the primary charger 602 through a varistor VS and a diode CD. At times other than the developing step, a potential E-9 of −200 volts, which is derived from a charge eliminating charger 608, is utilized in a manner similar to that mentioned above in connection with the embodiment shown in FIGS. 8 to 10. In addition, a developing electrode 604 is connected with the ground through a varistor VS-2 having a threshold value of 200 volts. The biasing effect is similar to those described in connection with the above embodiments.

A copying machine according to this embodiment also demonstrated an effect similar to that described above, producing a sharp image and causing no deposition of a toner onto the electrode 604.

While in the above description, the application of the bias potential has been timed to commence at a given time interval from illumination extinction of a lamp used in the optical system, it is to be noted that the bias potential may be changed immediately upon illumination, with a corresponding increase in the bias potential so as to compensate for a reduction in the cleaning effect of the developing dishplate.

It will be appreciated that, since the non-image region is charged to the same polarity as the toner, as such region passes by the developing electrode, the toner is attracted toward such region, thus avoiding a contamination of the developing electrode. Additionally, during the cleaning step, that region is clear from the influence of the bias potential applied to the developing electrode, so that the toner tends to be repelled from the non-image region having the same polarity, thus facilitating the cleaning action.

What is claimed is:

1. A developing process, for use in an electrophotographic copying machine of the wet developing type and which includes means providing an endless photosensitive surface cyclically movable along a predetermined endless path, and means disposed along the path for sequentially uniformly charging a portion of the photosensitive surface to a first potential, exposing the charged surface portion to an optical image to form an electrostatic latent image thereon, developing the latent image with a developing solution, having a toner dispersed therein of a charge opposite in polarity to the first potential, in a developing electrode arrangement maintained in opposing relation with the moving surface, removing any excessive solution from the moving surface, transferring the developed image onto copy sheets, cleaning the photosensitive surface, and eliminating any residual charge on the photosensitive surface, said process comprising the steps of charging at least the non-image portion of said moving surface to a second potential having a polarity opposite to that of the first potential at least prior to the time the non-image surface portion comes into opposing relationship with said electrode arrangement; maintaining, on said electrode arrangement, a third potential below a predetermined value which is lower than, and of the same polarity as, the first potential while said latent image carrying surface portion is passing by said electrode arrangement; and applying a fourth potential, lower than the second potential, to said electrode arrangement during the remaining time for one cycle that no image is present on said endless surface.

2. The process according to claim 1 wherein said applying potential step comprises applying, to said electrode arrangement, a fourth potential *Ve* which is derived from the following equation:

$$(|Ve| - |Vn|) \times T_2 = (Vc - Vg) \times T_1$$

wherein *Vn* represents a potential on said remaining surface portion achieved by said charging step, *Vc* represents a potential appearing on said electrode means during development, *Vg* represents a potential remaining in a background area of the latent image, $T_1$ represents the time during which said latent image carrying surface portion passes by said electrode means, and $T_2$ represents the remaining time for one cycle of said endless surface.

3. The process according to claim 1 wherein said charging step comprises sequentially charging said moving surface in its entirety prior to the charging by the first mentioned charging means, thereby to concurrently achieve the function of said eliminating means.

4. The process according to claim 1 wherein said potential maintaining step comprises connecting said electrode arrangement to the ground through constant voltage means having a threshold corresponding to said predetermined value.

5. The process according to claim 4 wherein said potential maintaining step comprises further applying a voltage to the junction between said electrode arrangement and said constant voltage means through timer means.

6. The process according to claim 4 wherein the first mentioned charging means comprises wire electrode means and shield case means for said wire electrode means, and said potential maintaining step comprises further connecting plate means, disposed within said case means and maintained in opposing relationship with said wire electrode means, to the junction between said developing electrode arrangement and said constant voltage means, through timer means.

7. The process according to claim 1 wherein said potential applying step comprises connecting said electrode arrangement to the ground through constant voltage means having a threshold corresponding to the fourth potential; and further connecting voltage source means to the junction between said electrode arrangement and said constant voltage means, through timer means.

8. The process according to claim 7 wherein said charge eliminating step comprises providing a charger means having a wire electrode and shield case for said wire electrode, and said further connecting step comprises using, as said voltage source, a plate disposed within said shield case maintained in opposing relationship with said wire electrode.

* * * * *